United States Patent [19]

Budzich

[11] 4,180,098

[45] Dec. 25, 1979

[54] LOAD RESPONSIVE FLUID CONTROL VALVE

[76] Inventor: Tadeusz Budzich, 80 Murwood Dr., Moreland Hills, Ohio 44022

[21] Appl. No.: 905,331

[22] Filed: May 12, 1978

Related U.S. Application Data

[63] Continuation-in-part of Ser. No. 773,421, Feb. 28, 1977, Pat. No. 4,122,865, and a continuation-in-part of Ser. No. 655,561, Feb. 5, 1976, Pat. No. 4,099,379.

[51] Int. Cl.[2] ..... F15B 13/08

[52] U.S. Cl. ..... 137/596.13; 91/421; 91/436; 91/446; 137/596.1

[58] Field of Search ..... 137/596, 596.13, 596.1; 91/421, 436, 446

[56] References Cited

U.S. PATENT DOCUMENTS

| | | | |
|---|---|---|---|
| 3,744,517 | 7/1973 | Budzich | 137/596.1 X |
| 3,882,896 | 5/1975 | Budzich | 137/596.1 |
| 3,998,134 | 12/1976 | Budzich | 137/596.13 X |
| 4,028,889 | 6/1977 | Budzich | 137/596.12 X |

*Primary Examiner*—Gerald A. Michalsky

[57] ABSTRACT

A direction flow control valve for control of positive and negative loads equipped with a load responsive positive and negative load control which automatically regulates valve inlet pressure to maintain a relatively constant pressure differential between inlet pressure and load pressure and throttles load pressure to maintain a constant pressure differential between the load pressure and outlet pressure. The load responsive control of direction flow control valve blocks the pump flow to the motor while controlling negative load, providing the motor inlet with fluid from the motor exhaust.

18 Claims, 1 Drawing Figure

LOAD RESPONSIVE FLUID CONTROL VALVE

This is a continuation-in-part of application Ser. No. 773,421 filed Feb. 28, 1977 for "Load Responsive Fluid Control Valve" now U.S. Pat. No. 4,122,865, and application Ser. No. 655,561 filed Feb. 5, 1976 for "Load Responsive Fluid Control System" now U.S. Pat. No. 4,099,379.

BACKGROUND OF THE INVENTION

This invention relates generally to load responsive fluid control valves and to fluid power systems incorporating such valves, which systems are supplied by a single fixed or variable displacement pump. Such control valves are equipped with an automatic load responsive control and can be used in a multiple load system, in which a plurality of loads is individually controlled under positive and negative load conditions by separate control valves.

In more particular aspects this invention relates to direction and flow control valves capable of controlling simultaneously a number of loads under both positive and negative load conditions.

In still more particular aspects this invention relates to direction and flow control valves capable of controlling simultaneously multiple positive and negative loads, which while controlling a negative load interrupt pump flow to the motor providing the motor inlet with fluid from the pressurizing system exhaust.

In still more particular aspects this invention relates to direction and flow control valves which throttle fluid to maintain a constant pressure differential between inlet and load pressure and load and outlet pressure while using a single throttling controller.

Closed center load responsive fluid control valves are very desirable for a number of reasons. They permit load control with reduced power losses and therefore, increased system efficiency and when controlling one load at a time provide a feature of flow control irrespective of the variation in the magnitude of the load. Normally such valves include a load responsive control, which automatically maintains pump discharge pressure at a level higher, by a constant pressure differential, than the pressure required to sustain the load. A variable orifice, introduced between pump and load, varies the flow supplied to the load, each orifice area corresponding to a different flow level, which is maintained constant irrespective of variation in magnitude of the load. The application of such a system is, however, limited by one basic system disadvantage.

Normally in such a system the load responsive valve control can maintain a constant pressure differential and therefore constant flow characteristics when operating only one load at a time. With two or more loads, simultaneously controlled, only the highest of the loads will retain the flow control characteristics, the speed of actuation of lower loads varying with the change in magnitude of the highest load. A fluid control valve for such a system is shown in U.S. Pat. No. 3,488,953, issued to Haussler.

This drawback can be overcome in part by the provision of a proportional valve as disclosed in my U.S. Pat. No. 3,470,694 dated Oct. 7, 1969 and also in U.S. Pat. No. 3,455,210 issued to Allen on July 15, 1969. However, while these valves are effective in controlling positive load they do not retain flow control characteristics when controlling negative loads, which instead of taking supply the energy to the fluid system and hence the speed of actuation of such a load in a negative load system will vary with the magnitude of the negative load. Especially with socalled overcenter loads, where a positive load may become a negative load, such a valve will lose its speed control characteristics in the negative mode.

This drawback can be overcome by the provision of a load responsive fluid control valve as disclosed in my U.S. Pat. No. 3,744,517 issued July 10, 1973 and my U.S. Pat. No. 3,882,896 issued May 13, 1975. However, while these valves are effective in controlling both positive and negative loads, with pump pressure responding to the highest pressure of a system load being controlled, they utilize a controlling orifice located in the motor exhaust during negative load mode of operation and therefore control the fluid flow out of the fluid motor. These valves also during control of negative loads supply the motor inlet with throttled down fluid from the pump circuit, therefore using flow from the pump, while controlling a negative load. In certain fluid power control systems it is preferable, while controlling a negative load, to supply fluid to the motor inlet from the motor exhaust circuit instead of using pump capacity.

These drawbacks can be overcome in part by provision of fluid control valves as disclosed in U.S. Pat. No. 3,807,447 issued to Masuda on Apr. 30, 1974. However, while these valves utilize actuator exhaust fluid for actuator inlet flow requirement when controlling negative loads and also utilize a controlling orifice located between the pump and the actuator while controlling positive and negative loads they regulate actuator inlet pressure by bypassing fluid to a down stream load circuit. Masuda's valves and their proportional control system are based on series type circuit in which excess fluid flow is successively diverted from one valve to the other and in which loads arranged in series determine the system pressure. In such a system flow to the last valve operating a load must be delivered through all of the bypass sections of all of the other system valves, resulting in fluid throttling loss. These valves are not adaptable to simultaneous control of multiple loads in parallel circuit and they do not provide system load control pressure signal to the pump flow control mechanism.

SUMMARY OF THE INVENTION

It is therefore a principal object of this invention to provide improved load responsive fluid direction and flow control valves which block system pump from motor inlet and supply it with system exhaust flow when controlling negative loads, while transmitting control signals to system pump to maintain the pressure of the system pump higher, by a constant pressure differential, than the highest pressure of the system positive load being controlled.

Another object of this invention is to provide load responsive fluid direction and flow control valves, which load responsive fluid direction and flow control valves are provided with a pressurized exhaust manifold, flow from which supplies the inlet flow requirements of motors controlling negative loads.

It is a further object of this invention to provide load responsive fluid direction and flow control valves which retain their control characteristics during control of positive loads, while responding to a pressure differential developed across a variable orifice located between the pump and the actuator and which retain their control characteristics during control of negative loads while responding to a pressure differential developed across a variable orifice located between actuator and exhaust manifold.

It is a further object of this invention to provide load responsive fluid direction and flow control valves which control both positive and negative loads while using a single throttling controller.

Briefly the foregoing and other additional objects and advantages of this invention are accomplished by providing a novel load responsive fluid control system for use during proportional simultaneous control of multiple positive and negative loads. A system pump is controlled in respect to pressure signal transmitted from system valves, corresponding to the highest system load pressure. The exhaust circuit of the system is pressurized, the exhaust flow being used to provide inlet flow requirements of motors controlling negative loads. Valve controls during control of positive and negative loads respond to pressure differentials developed across variable orifices in the actuator inlet and outlet while using a single controller.

Additional objects of this invention will become apparent when referring to the preferred embodiments of the invention as shown in the accompanying drawing and described in the following detailed description.

DESCRIPTION OF THE PREFERRED EMBODIMENT

Figure 1:
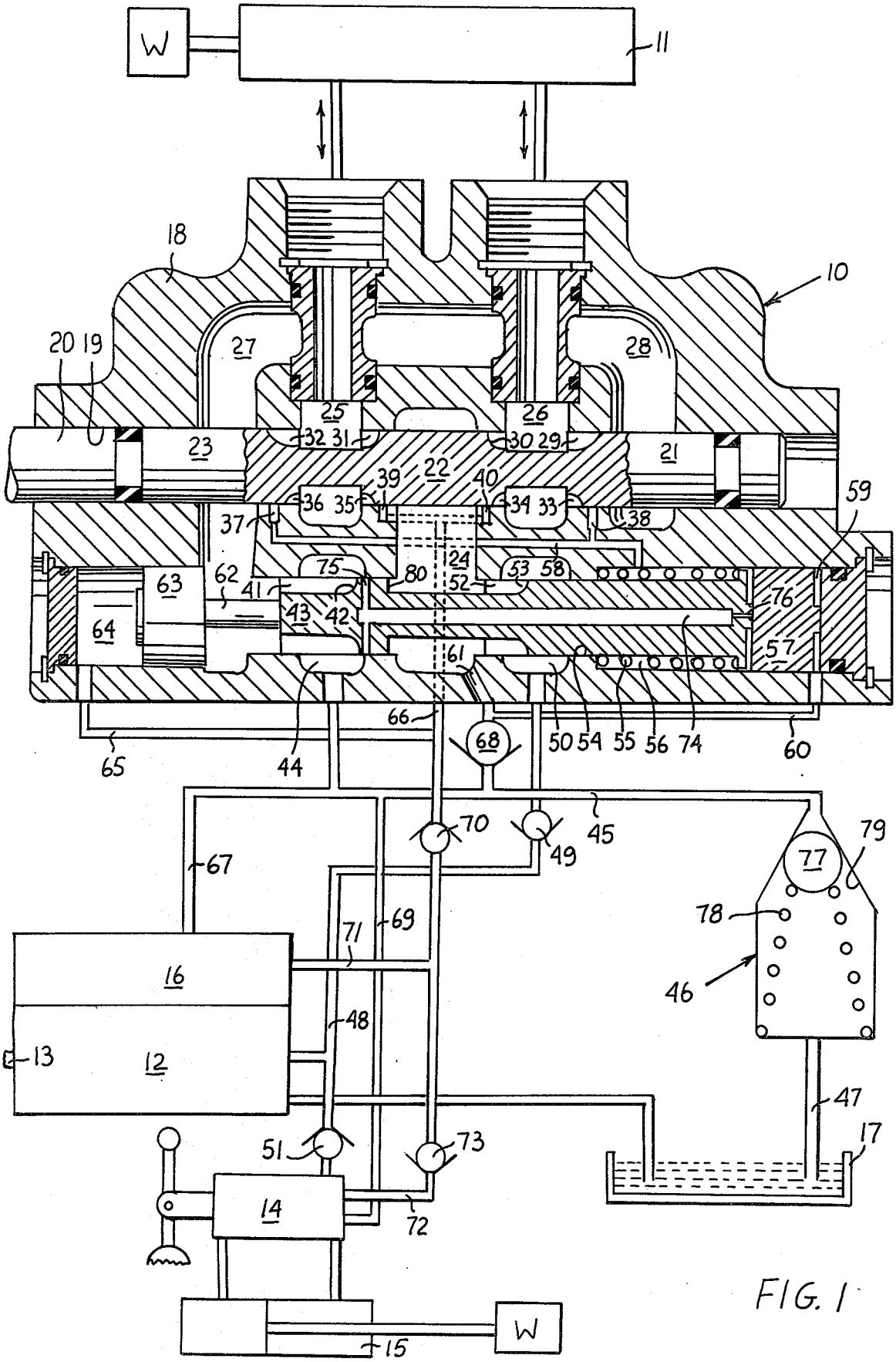
FIG. 1 is a longitudinal sectional view of an embodiment of a flow control valve having a positive load control responsive to actuator upstream pressure differential and negative load controls responsive to actuator down stream pressure differential while using a single throttling controller for use in a load responsive fluid control system, with lines, system flow control, system pump, second load responsive valve, exhaust relief valve and system reservior shown diagrammatically.

Referring now to FIG. 1, an embodiment of a flow control valve, generally designated as 10, is shown interposed between diagrammatically shown fluid motor 11 driving load W and a pump 12 of a fixed displacement or variable displacement type driven through a shaft 13 by a prime mover not shown.

Similarly, a flow control valve 14, identical to flow control valve 10, is interposed between a diagrammatically shown fluid motor 15 driving a load W and the pump 12. Fluid flow from the pump 12 to flow control valves 10 and 14 is regulated by a pump flow control 16. If pump 12 is of a fixed displacement type, pump flow control 16 is a differential pressure relief valve, which is a well known manner, by bypassing fluid from the pump 12 to a reservoir 17, maintains discharge pressure of pump 12 at a level, higher by a constant pressure differential, than load pressure developed in fluid motor 11 or 15. If pump 12 is of a variable displacement type pump flow control 16 is a differential pressure compensator, well known in the art, which by changing displacement of pump 12 maintains discharge pressure of pump 12 at a level, higher by a constant pressure differential, than load pressure developed in fluid motor 11 or 15.

The flow control valve 10 is of a fourway type and has a housing 18 provided with a bore 19, axially guiding a valve spool 20. The valve spool 20 is equipped with lands 21, 22 and 23, which in neutral position of the valve spool 20, as shown in FIG. 1 isolate a fluid supply chamber 24, load chambers 25 and 26 and outlet chambers 27 and 28. Lands 21, 22 and 23 of valve spool 20 are provided with metering slots 29, 30, 31 and 32 and signal slots 33, 34, 35 and 36. Negative load sensing ports 37 and 38 are positioned between load chambers 25 and 26 and outlet chambers 27 and 28. Positive load sensing ports 39 and 40 are located between supply chamber 24 and load chambers 25 and 26. Negative load throttling slots 41 of control spool 43 equipped with throttling edges 42, connect outlet chambers 27 and 28 with exhaust chamber 44, which in turn is connected by exhaust line 45, exhaust relief valve, generally designated as 46, and line 47 to reservoir 17.

The pump 12 through its discharge line 48 and load check valve 49 is connected to an inlet chamber 50. Similarly discharge line 48 is connected through load check valve 51 with inlet chamber of the fluid control valve 14.

The inlet chamber 50 is connected through positive load throttling slots 52 on control spool 43, provided with throttling edges 53, with the fluid supply chamber 24. Bore 54 axially guides control spool 43, which is biased by control spring 55 contained in control space 56, towards engagement with free floating piston 57, as shown on FIG. 1. Control spool 43 at one end projects into control space 56, the other end projecting into outlet chamber 27. Control space 56 is connected through line 58 with negative load sensing ports 37 and 38. Free floating piston 57 on one side is subjected to pressure in control space 56 and on the other side to pressure in space 59, which is connected by line 60 and port 61 with the supply chamber 24. The end of the control spool 43, equipped with negative load throttling slots 41, is selectively engagable by stem 62 of free floating piston 63, which projects into a control chamber 64, connected by lines 65 and signal passage 66 with the positive load sensing ports 39 and 40.

If the pump 12 is of a fixed displacement type, excess pump flow from pump flow control 16, which is then in the form of a differential pressure bypass valve, is delivered through line 67 to the exhaust line 45, which communicates with exhaust chamber 44, a bypass check valve 68, the exhaust relief valve 46 and through line 69 with all of the exhaust passages of the flow control valve 14. The bypass check valve 68 is interposed between exhaust line 45 and the fluid supply chamber 24.

Positive load sensing ports 39 and 40, located between load chambers 25 and 26 and the supply chamber 24 and blocked in neutral position of valve spool 20 by land 22, are connected through signal passage 66, a check valve 70 and signal line 71 to the pump flow control 16. In a similar manner positive load sensing ports of flow control valve 14 are connected through line 72 and check valves 73 and signal line 71 to the pump flow control 16.

The control spool 43 is equipped with a passage 74, which on one end, through passage 75, communicates with the exhaust chamber 44, the other end of passage 74 communicating through leakage orifice 76 with control space 56.

The exhaust relief valve, generally designated as 46, interposed between combined exhaust circuits of flow control valves 10 and 14, including bypass circuit of pump 12 and reservoir 17, is provided with a throttling member 77, biased by a spring 78 towards engagement with seat 79.

The signal slots 33, 34, 35 and 36 are located in the plane of positive load sensing ports 39 and 40 and negative load sensing ports 37 and 38, which, in a well known manner, can be circumferentially spaced from the plane containing metering slots 29, 30, 31 and 32. Signal slots 33, 34, 35 and 36, in a well known manner, can be substituted by surfaces of lands 21, 22 and 23. A suitable device is provided to prevent relative rotation of the valve spool 20 in respect to bore 54.

The preferable sequencing of the control spool 43 is such that when moved from right to left, when throttling edges 53 close communication between the inlet chamber 50 and the supply chamber 24, control surface 80 is positioned at the point of opening communication between the supply chamber 24 and the exhaust chamber 44. Further movement of the control spool 43 from right to left will gradually establish full flow communication between the exhaust chamber 44 and the supply chamber 24.

The sequencing of the lands and slots of valve spool 20 preferably is such, that when displaced in either direction from its neutral position, as shown in FIG. 1, one of the load chambers 25 or 26 is connected by signal slots 35 or 34 to the positive load sensing port 39 or 40, while the other load chamber is simultaneously connected by signal slots 33 or 36 with negative load sensing ports 38 or 37, the load chambers 25 and 26 still being isolated from the supply chamber 24 and outlet chambers 27 and 28. Further displacement of valve spool 20 from its neutral position connects load chamber 25 or 26 through metering slots 29 or 32 with load chamber 28 or 27, while land 22 still isolates one of the outlet chambers from the supply chamber 24. Still further displacement of the valve spool 20 from its neutral position connects through metering slots 30 or 31 one of load chambers with the supply chamber 24.

As previously described the pump flow control 16, in a well known manner, will regulate fluid flow delivered from pump 12 to discharge line 48, to maintain the pressure in discharge line 48 higher, by a constant pressure differential, than the highest load pressure signal transmitted through the check valve system to the signal line 71. Therefore, with valve spools of flow control valves 10 and 14 in their neutral position blocking positive load sensing ports 39 and 40, signal pressure input to pump flow control 16 from the signal line 71 will be at minimum pressure level.

With pump 12 of a fixed displacement type started up, the pump flow control 16 will bypass through line 67, exhaust line 45, the exhaust relief valve 46 and line 47 all of the pump flow to the system reservoir 17 at minimum pressure level, equivalent to preload in the spring 78, while automatically maintaining pressure in discharge line 48 at a constant pressure, higher by a constant pressure differential, than pressure in signal line 71 or pressure in exhaust line 45. Therefore all of pump flow is diverted by the pump flow control 16 to the low pressure exhaust circuit, as previously described, without being used by flow control valves 10 and 14. The pressure setting of exhaust relief valve 46 is selected to provide the necessary pressure drop through metering slots 30 and 31, to maintain load chamber 25 or 26 at above atmospheric pressure.

With pump 12 of a variable displacement type, under working conditions, minimum flow to the system exhaust manifold, composed of lines 69, 67, exhaust line 45 and exhaust pressure relief valve 46, may have to be diverted from the pump 12, to maintain the system exhaust manifold pressurized. A pressure reducing type regulator can be used, which upon system exhaust manifold pressure dropping below the setting of the exhaust pressure relief valve 46, will throttle some of the pump discharge flow and supply it to the exhaust manifold, to maintain it at a certain preselected minimum pressure level.

Assume that the load chamber 25 is subjected to a positive load. The initial displacement of the valve spool 20 to the right will connect the load chamber 25 through signal slot 35 with positive load sensing port 39, while lands 21, 22 and 23 still isolate the supply chamber 24, load chambers 25 and 26 and outlet chambers 28 and 27. As previously described positive load signal, transmitted from positive load sensing port 39, through signal passage 66, check valve system and signal line 71 to the pump flow control 16 will increase the pressure in discharge line 48 to a level, which is higher by a constant pressure differential than the load pressure signal. The positive load signal will be also transmitted through line 65 to the control chamber 64, reacting on the cross-sectional area of free floating piston 63, moving it to the right and engaging with stem 62 the control spool 43. The pump pressure signal transmitted from the inlet chamber 50, positive load throttling slots 52, port 61 and line 60 to space 59 will react on cross-sectional area of free floating piston 57. Communication will be maintained between the supply chamber 24 and the inlet chamber 50, as long as the pump flow control 16 maintains a constant pressure differential between the pump discharge pressure and the positive load pressure.

Further displacement of the valve spool 20 to the right will connect through metering slot 29 the load chamber 26 with outlet chambers 28 and 27, while land 22 still isolates the load chambers 25 from the supply chamber 24. Since the load chamber 26 is subjected to low pressure no change in position of the control spool 43 will take place.

Still further displacement of the valve spool 20 to the right will connect the load chamber 25, through metering slot 31 with the supply chamber 24 and will also enlarge through metering slot 29 the passage to the outlet chamber 28. In a manner as previously described, the pump flow control 16 will maintain a constant pressure differential across orifice, created by displacement of metering slot 31, the flow into the load chamber 25 being proportional to the area of the orifice and therefore displacement of the valve spool 20 from its neutral position and independent of the magnitude of the load W.

Assume that while controlling positive load W through the flow control valve 10, a higher positive load W is actuated through the flow control valve 14. Higher load pressure signal from the flow control valve 14 will be transmitted through the check valve system to the pump flow control 16, which will now maintain system pressure, higher by a constant pressure differential, than pressure generated by positive load W. In a manner as previously described, the pressure drop through metering slot 31 will increase, therefore increasing the pressure differential between space 59 and the control chamber 64. The control spool 43 will move into its modulating position, throttling with throttling edges 53 the fluid flowing from the inlet chamber 50 to the supply chamber 24, to maintain a constant pressure differential between the supply chamber 24 and the load chamber 25, thus controlling fluid flow through metering slot 31.

Assume that the load chamber 26 is subjected to a negative load W and that the valve spool 20 is displaced from its neutral position to the right while, as previously described, the control spool 43 is maintained in the position as shown in FIG. 1. Initial displacement of the valve spool 20 will connect through signal slot 35 the load chamber 25 with the positive load sensing port 39, while connecting through signal slot 33 the load chamber 26 with the negative load sensing port 38.

Negative load pressure, from the negative load sensing port 38 will be transmitted through line 58 to control space 56, where reacting on the cross-sectional area of the control spool 43 will move it against the bias of the control spring 55, all the way to the left, blocking communication by throttling edges 42 between the outlet chamber 27 and the exhaust chamber 44. Since the supply chamber 24, in this position of control spool 43, is directly connected to the exhaust chamber 44 through the displacement of control surface 80 and also connected by bypass check valve 68 to exhaust line 45, the supply chamber 24 is subjected to the exhaust manifold pressure, which is transmitted through line 60 to space 59. Therefore free floating piston 57 is maintained by negative load pressure in control space 56 all the way to the right, out of contact with the control spool 43. Load chamber 25, which is subjected to zero pressure, is connected through the signal slot 35 to the positive load sensing port 39, which through signal passage 66 and line 65 maintains the exhaust chamber 64 at zero pressure.

Further displacement of valve spool 20 to the right will connect through metering slot 29 the outlet chamber 28 with the load chamber 26, while also connecting through metering slots 31 the load chamber 25 with the supply chamber 24. Since the outlet chambers 28 and 27 are isolated by the position of the control spool 43, the pressure in the outlet chamber 27 will begin to rise, until it will reach a level, at which force generated on the cross-sectional area of the control spool 43, by the pressure in the outlet chamber 27, will equal the difference of the force generated on the same cross-sectional area by the pressure in the control space 56 and the biasing force of the control spring 55. At this point the control spool 43 will move from left to right into a modulating position, in which fluid flow from the outlet chamber 27 to the exhaust chamber 44 will be throttled by the throttling edges 42, to automatically maintain a constant pressure differential, equivalent to biasing force of the control spring 55, between the outlet chamber 27 and the control space 56. Since during control of negative load a constant pressure differential is maintained across the orifice, created by the displacement of metering slot 29, by the throttling action of control spool 43, fluid flow through metering slot 29 will be proportional to the displacement of the valve spool 20 and constant for each specific position of metering slot 29, irrespective of the change in the magnitude of the negative load W. The free floating piston 63, subjected to negative load pressure, will be moved all the way to the left, out of contact with the control spool 43 and maintained in this position while the negative load is being controlled.

As previously described, during control of negative load the control spool 43 will be maintained in a position, where it isolates by throttling edges 42 the inlet chamber 50 from the supply chamber 24, while establishing full flow communication between the exhaust chamber 44 and the supply chamber 24. The exhaust line 45 is also in direct communication with the supply chamber 24 through bypass check valve 68. In this way, during control of negative load, the supply chamber 24 is connected through the exhaust chamber 44 and exhaust line 45 to the total exhaust manifold of flow control valves 10 and 14, pressurized by the exhaust relief valve 46. The pressure setting of the exhaust relief valve 46 is high enough to provide the necessary pressure drop through metering slot 31, at the highest rates of flow from the supply chamber 24 to the load chamber 25, without pressure in the load chamber 25 dropping below atmospheric level, thus preventing any possibility of cavitation. In this way, during control of negative load, the inlet flow requirement of the actuator is not supplied from the pump circuit but from the pressurized exhaust circuit of flow control valves 10 sand 14, conserving the pump flow and increasing system efficiency. If negative load pressure is not sufficiently high to provide a constant pressure drop through metering slot 29, the control spool 43, under action of control spring 55 will move to the right from its modulating and throttling position at negative load throttling slots 41, closing with control surface 80 communication between the exhaust chamber 44 and the supply chamber 24 and opening with throttling edges 53 communication between the inlet chamber 50 and the supply chamber 24. The bypass check valve 68 will close and the pressure in the supply chamber 24 will begin to rise. This rising pressure in supply chamber 24 will produce a positive load pressure in the load chamber 25 and will be transmitted through line 60 to space 59, where, reacting on the cross-sectional area of the free floating piston 57 will tend to move it from right to left, engaging control spool 43. The rising pressure in the load chamber 25 will be transmitted through the positive load sensing port 39, through signal passage 66 and line 65 to the control chamber 64, moving the free floating piston 63 to the right and engaging with stem 62 the control spool 43. The positive load pressure signal will also be transmitted through check valve 70 and signal line 71 to pump flow control 16, which will maintain a constant pressure differential, in absence of control signal from control valve 14, between the pump discharge pressure and pressure in load chamber 25. Under these conditions the control spool 43 will move all the way from left to right and constant pressure differential will be maintained through metering slot 31, the positive load helping the negative load to maintain the velocity profile, as dictated by the position of the valve spool 20.

If control valve spool 14 starts to control a positive load, in a manner as previously described, the pump discharge pressure will rise, the pressure differential across metering slot 31 will increase and the control spool 43 will move from right to left into a modulating position, throttling with throttling edges 53, flow from the inlet chamber 50 to the supply chamber 24.

Once the negative load will increase to a level that is capable of maintaining the required pressure drop through metering slot 29, the control spool 43 will automatically move from right to left connecting the supply chamber 24 with the pressurized exhaust system and throttling with the throttling edges 42 flow of fluid under negative load pressure from the outlet chamber 27 to the exhaust chamber 44.

During control of negative load the system exhaust manifold is not only connected with the supply chamber through the exhaust chamber but also through bypass check valve 68. The bypass check valve 68 is only needed in certain applications, in which a change from positive to negative load can occur at high rates of flow, like for example in hydrostatic transmission circuit, well known in the art. For most of the applications controlling hydraulic cylinders the bypass check valve 68 can be dispensed with.

As shown in FIG. 1 the free floating pistons 57 and 63 are of a larger diameter than the control spool 43. If desired, in a well known manner, the pistons 57 and 63 can be slidably mounted in a bore provided in end sealing plugs and be of the same or even smaller diameter than control spool 43. In FIG. 1 the control chamber 64 is directly connected to pressure in the positive load sensing ports 39 and 50. In a well known manner the control chamber 64 can be connected by a suitable leakage orifice to the system exhaust manifold, to improve operation of load responsive valve control in a similar way as done by connecting control space 56 by leakage orifice 76 and passages 74 and 75 to the exhaust chamber 44.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly supplied with pressure fluid by a pump, said valve assembly comprising a housing having a fluid inlet chamber, a fluid supply chamber, first and second load chambers, and fluid exhaust means connected to reservoir means, first valve means for selectively interconnecting said fluid load chambers with said fluid supply chamber and said fluid exhaust means, first variable metering orifice means responsive to movement of said first valve means and operable to meter fluid flow between said fluid supply chamber and said load chambers, second variable metering orifice means responsive to movement of said first valve means and operable to meter fluid flow between said load chambers and said fluid exhaust means, second valve means having first fluid throttling means between said fluid inlet chamber and said fluid supply chamber, second fluid throttling means between said load chambers and said fluid exhaust means, and sequencing means connecting said first fluid throttling means and said second fluid throttling means, first control means of said second valve means responsive to pressure differential across said first variable orifice means and operable to maintain said pressure differential across said first variable orifice means at a relatively constant level, and second control means of said second valve means responsive to pressure differential across said second variable orifice means and operable to maintain said pressure differential across said second variable orifice means at a relatively constant level.

2. A valve assembly as set forth in claim 1 wherein said valve assembly has positive load pressure sensing means in said housing selectively communicable with said load chambers by said first valve means.

3. A valve assembly as set forth in claim 2 wherein said positive load pressure sensing means has means communicable with said first control means on said second valve means and means operable to transmit positive load pressure signal to said pump.

4. A valve assembly as set forth in claim 1 wherein said valve assembly has negative load pressure sensing means in said housing selectively communicable with said load chambers by said first valve means.

5. A valve assembly as set forth in claim 4 wherein said negative load pressure sensing means has means communicable with said second control means on said second valve means.

6. A valve assembly as set forth in claim 1 wherein said second valve means has fluid isolating means between said fluid inlet chamber and said fluid supply chamber operable to isolate said fluid inlet chamber from said fluid supply chamber when said second throttling means throttles fluid flow between one of said load chambers and said fluid exhaust means.

7. A valve assembly as set forth in claim 6 wherein said valve assembly has fluid replenishing means operable to supply fluid flow from said fluid exhaust means to one of said load chambers which is not pressurized when said fluid isolating means isolate said fluid supply chamber from said fluid inlet chamber.

8. A valve assembly as set forth in claim 1 wherein said first and second control means have actuating means responsive to pressure differential across said first and second variable metering orifice means.

9. A valve assembly as set forth in claim 1 wherein said second fluid throttling means is positioned down stream of said second variable orifice means.

10. A valve assembly as set forth in claim 1 wherein exhaust pressure relief valve means is positioned in said fluid exhaust means between said first and second load chambers and said reservoir means.

11. A valve assembly as set forth in claim 1 wherein said sequencing means has a fluid throttling spool, said first and second fluid throttling means being positioned on said fluid throttling spool.

12. A valve assembly supplied with pressure fluid by a pump, said valve assembly comprising a housing having a fluid inlet chamber, a fluid supply chamber, first and second load chambers, and fluid exhaust means connected to reservoir means, first valve means for selectively interconnecting said fluid load chambers with said fluid supply chamber and said fluid exhaust means, first variable metering orifice means responsive to movement of said first valve means and operable to meter fluid flow between said fluid supply chamber and said load chambers, second variable metering orifice means responsive to movement of said first valve means and operable to meter fluid flow between said load chambers and said fluid exhaust means, second valve means having fluid throttling spool means, first fluid throttling means on said fluid throttling spool means between said fluid inlet chamber and said fluid supply chamber, second fluid throttling means on said fluid throttling spool means between said load chambers and said fluid exhaust means, first control means of said second valve means responsive to pressure differential across said first variable orifice means and operable to maintain said pressure differential across said first variable orifice means at a relatively constant level, said first control means having first means selectively engagable with said fluid throttling spool means, and second control means of said second valve means responsive to pressure differential across said second variable orifice means and operable to maintain said pressure differential across said second variable orifice means at a relatively constant level, said second control means having second means selectively engagable with said fluid throttling spool means.

13. A valve assembly as set forth in claim 12 wherein said valve assembly has positive load pressure sensing means in said housing selectively communicable with said load chambers by said first valve means.

14. A valve assembly as set forth in claim 13 wherein said positive load pressure sensing means has means communicable with said first control means of said second valve means and means operable to transmit positive load pressure signal to said pump.

15. A valve assembly as set forth in claim 12 wherein said valve assembly has negative load pressure sensing means in said housing selectively communicable with said load chambers by said first valve means.

16. A valve assembly as set forth in claim 15 wherein said negative load pressure sensing means has means communicable with said second control means of said second valve means.

17. A valve assembly as set forth in claim 12 wherein said second valve means has fluid isolating means between said fluid inlet chamber and said fluid supply chamber operable to isolate said fluid inlet chamber from said fluid supply chamber when said second throttling means throttles fluid flow between one of said load chambers and said fluid exhaust means.

18. A valve assembly as set forth in claim 17 wherein said valve assembly has fluid replenishing means operable to supply fluid flow from said fluid exhaust means to one of said load chambers which is not pressurized when said fluid isolating means isolate said fluid supply chamber from said fluid inlet chamber.

* * * * *